US008479664B2

(12) United States Patent
Nelson

(10) Patent No.: US 8,479,664 B2
(45) Date of Patent: Jul. 9, 2013

(54) BARRICADE ATTACHABLE ACTIVITY SURFACE

(75) Inventor: Hans Edward Nelson, Seattle, WA (US)

(73) Assignee: H.E. Nelson Inc, Seattle, WA (US)

( * ) Notice: Subject to any disclaimer, the term of this patent is extended or adjusted under 35 U.S.C. 154(b) by 580 days.

(21) Appl. No.: 12/257,409

(22) Filed: Oct. 24, 2008

(65) Prior Publication Data

US 2010/0101459 A1 Apr. 29, 2010

(51) Int. Cl.
*A47B 23/00* (2006.01)

(52) U.S. Cl.
USPC ..... 108/42; 108/135; 108/152

(58) Field of Classification Search
USPC ..... 108/42, 135, 134, 27, 152; 312/313, 312/316; 5/507.1, 503.1, 947, 3, 622–624; 182/129; 248/311.2, 312.1, 340
See application file for complete search history.

(56) References Cited

U.S. PATENT DOCUMENTS

| | | | | | |
|---|---|---|---|---|---|
| 1,197,891 | A * | 9/1916 | Barnes | 108/134 |
| 2,170,799 | A * | 8/1939 | Jones | 108/134 |
| 2,536,731 | A * | 1/1951 | Douglas | 4/547 |
| 2,687,336 | A * | 8/1954 | Smith et al. | 297/163 |
| 3,427,667 | A * | 2/1969 | Ratcliff | 5/3 |
| 4,889,057 | A * | 12/1989 | Chartrand | 108/42 |
| 4,958,392 | A * | 9/1990 | Cannady | 5/507.1 |
| 4,974,523 | A * | 12/1990 | Giarratana | 108/42 |
| 5,022,617 | A * | 6/1991 | Henderson | 248/125.8 |
| 5,193,695 | A * | 3/1993 | Mann | 211/104 |
| 5,381,738 | A * | 1/1995 | Meyer | 108/42 |
| 5,409,083 | A * | 4/1995 | Thompson et al. | 182/187 |
| 5,469,794 | A * | 11/1995 | Laderoute et al. | 108/48 |
| 5,509,158 | A * | 4/1996 | Morrison | 5/504.1 |
| 5,528,993 | A * | 6/1996 | Vincelli | 108/48 |
| 5,568,773 | A * | 10/1996 | Hung | 108/50.02 |
| 5,653,178 | A * | 8/1997 | Huczka | 108/47 |
| 5,709,155 | A * | 1/1998 | Terracciano | 108/42 |
| 6,055,688 | A * | 5/2000 | Helmsderfer et al. | 5/655 |
| 6,105,509 | A * | 8/2000 | Altfeder | 108/42 |
| 6,224,029 | B1 * | 5/2001 | Marble et al. | 248/214 |
| 6,269,503 | B1 * | 8/2001 | Betker | 5/655 |
| 6,546,879 | B1 * | 4/2003 | Johnston | 108/47 |
| 6,931,998 | B1 * | 8/2005 | Leese | 108/42 |
| 7,043,778 | B1 * | 5/2006 | Georgitsis et al. | 5/93.1 |
| 7,121,213 | B2 * | 10/2006 | Viazanko et al. | 108/42 |
| 7,210,414 | B1 * | 5/2007 | Barone | 108/42 |
| 7,966,948 | B1 * | 6/2011 | Galietti | 108/42 |
| 2004/0094071 | A1 * | 5/2004 | Goeller | 108/42 |
| 2004/0112258 | A1 * | 6/2004 | Fichman | 108/38 |
| 2005/0263039 | A1 * | 12/2005 | Frampton et al. | 108/42 |
| 2010/0101459 | A1 * | 4/2010 | Nelson | 108/47 |

* cited by examiner

*Primary Examiner* — Janet M Wilkens
*Assistant Examiner* — Daniel Rohrhoff
(74) *Attorney, Agent, or Firm* — Ash Tankha; Lipton, Weinberger & Husick

(57) ABSTRACT

An apparatus attachable to a barricading structure and method for providing an activity surface are provided. The barricading structure may be, for example, a railing. The apparatus comprises a mountable backsplash attached to the barricading structure, a foldable support platform attached to the mountable backsplash via multiple connectors, and a locking system for locking the mountable backsplash to the barricading structure. The foldable support platform comprises a first inlay fitted into a support structure for providing an activity surface to hold objects. The connectors are accommodated in slots provided on the mountable backsplash. The accommodated connectors are hinged to the mountable backsplash using a hinge pin to facilitate pivotal connection of the foldable support platform to the mountable backsplash. The apparatus may comprise leg supports for supporting weight of the foldable support platform. The apparatus is made of a weather resistant material and a heat resistant material.

16 Claims, 17 Drawing Sheets

BARRICADE ATTACHABLE ACTIVITY SURFACE

BACKGROUND

This invention in general, relates to foldable activity surfaces. More particularly, this invention relates to an apparatus that detachably attaches to a barricading structure to provide an activity surface.

Pieces of furniture, for example, a table, a shelf, etc, provide an activity surface on which objects, for example, food, drinks, books, etc. may be placed. These pieces of furniture are typically bulky and occupy significant space. If such pieces of furniture are placed in a limited space, for example, a balcony, deck, patio, etc., the available or free area in the limited space will be further reduced or limited. Hence there is a need for an apparatus universally attachable to different barricading surfaces for example, a railing on a balcony, deck, patio, etc. to provide a surface on which objects may be placed, without reducing or restricting the free or unoccupied space in such spaces.

In general, foldable activity surfaces are difficult to set up against a vertical barricading structure, for example, a railing. Pivoting a foldable activity surface against a railing is typically done using different components, for example, rivet pins, brackets, etc, which require holes to be drilled into the railing thereby damaging the railing. Moreover, when such activity surfaces are attached to the barricading structure, the height of the activity surface is generally not readily adjustable on the barricading structure. Furthermore, some foldable activity surfaces are difficult to adapt to railings of different types and widths. Hence there is a need for an apparatus that is universally detachably attachable to a barricading structure without damaging the barricading structure.

Also, objects placed on the foldable activity surfaces may fall off the activity surface in the space between the barricading structure and the foldable activity surface. Also, foldable activity surfaces mounted outdoors are frequently subject to changing weather conditions, for example, rain, extreme heat, etc., leading to deterioration of the material of the foldable activity surface. The material of the activity surface may not be replaceable and replacing the entire foldable activity surface may be expensive.

Hence there is a need for an apparatus attachable to a barricading structure that provides an activity surface and is easy to install by a user. There is also a need for an apparatus that is resistant to different elements and is easily replaceable. There is also a need for an apparatus that is adaptable to barricading or railing structures fabricated with different materials in different design configurations.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The apparatus and method disclosed herein addresses the above stated needs for providing an activity surface that is detachably attached to a barricading structure. The barricading structure may, for example, be a railing, a fence, a vertical picket, a flat horizontal surface, a flat vertical surface, a wall, an elevated platform, a door, a desk, etc. fabricated in different design configurations. The barricading structure may be made of different materials and of different sizes. For example, the apparatus may be attached to railings made of plastic, metal, wood, glass, cement, etc. The apparatus serves as a piece of furniture, for example, a table, a shelf, etc. and is easily installed by a user. The apparatus is also resistant to weather conditions and is easily replaceable. The apparatus disclosed herein is further adaptable to barricading structures fabricated in different design configurations and made of different materials.

The apparatus disclosed herein comprises a mountable backsplash, a foldable support platform, and multiple connectors. The mountable backsplash is detachably attached to the barricading structure. The mountable backsplash may be of a clamshell design allowing connections to be hidden from view. The mountable backsplash comprises multiple slots. The foldable support platform is attached to the mountable backsplash via the connectors. The connectors are accommodated in the slots for connecting the foldable support platform to the mountable backsplash. The accommodated connectors are hinged to the mountable backsplash using a hinge pin to facilitate pivotal connection of the foldable support platform to the mountable backsplash. Axial movement of the connectors about the hinge pin enables folding and unfolding of the foldable support platform.

The foldable support platform comprises a first inlay fitted into a support structure for providing an activity surface to hold one or more objects. The objects may, for example, be a drink, food, a book, etc. The mountable backsplash comprises a second inlay fitted into a back support for preventing the objects from falling off the foldable support platform. The first inlay and the second inlay are replaceable.

The apparatus further comprises a locking system. The locking system locks the mountable backsplash to the barricading structure. The locking system may, for example, comprise one or more of a hook panel, multiple height adjustment cables, multiple suction cups, an adjustable hooking unit, and multiple hook and loop fasteners. The hook panel is attached inside the back support of the mountable backsplash. The hook panel secures the height adjustment cables in order to suspend the apparatus using the height adjustment cables. The hook panel controls adjustment of the height of the apparatus on the barricading structure to multiple height adjustment cables using the height adjustment cables. The hook and loop fasteners fasten the apparatus to the barricading structure. The rear surface of the mountable backsplash comprises one or more openings for inserting one or more suction cups. The suction cups fasten the apparatus onto a smooth surface or a coarse surface. The mountable backsplash may be mounted onto the barricading structure using the adjustable hooking unit attached to the hook panel. The mountable backsplash and the foldable support platform may be rounded at edges for appearance and safety.

The apparatus further comprises multiple leg supports. The leg supports are hinged to the mountable backsplash for supporting the weight of the foldable support platform. A clearance is provided between the leg supports and an underlying surface. The leg supports are foldable. The mountable backsplash and the support platform may comprise multiple openings for draining accumulated water. Coupling members may be provided for connecting multiple apparatuses and aligning the apparatuses at the same height with respect to each other. Each of the connected apparatuses may be used independently. The apparatus may be made of a weather resistant material and a heat resistant material. The apparatus further comprises end caps for providing a protective covering for both ends of the mountable backsplash.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
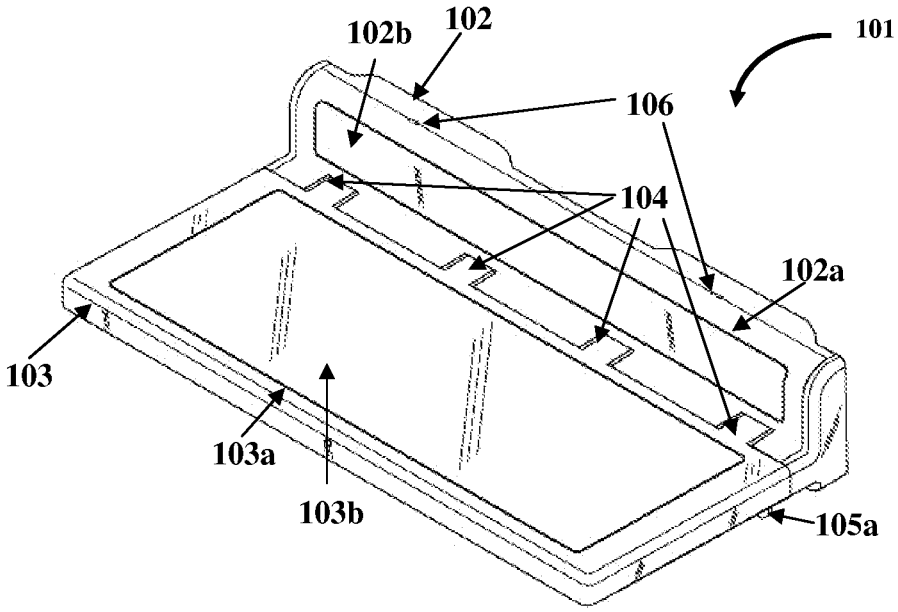
FIG. 1 illustrates an apparatus detachably attachable to a barricading structure for providing an activity surface.

FIG. 1 illustrates an apparatus 101 detachably attachable to a barricading structure 1401 for providing an activity surface. The barricading structure 1401 may, for example, be a railing, a fence, a vertical picket, a flat horizontal surface, a flat vertical surface, a wall, a floor, an elevated platform, a desk, and a door fabricated in different design configurations. The barricading structure 1401 may be made of different materials and of different sizes. For example, the apparatus 101 may be attached to railings made of plastic, metal, wood, glass, cement, etc. The apparatus 101 may be used to provide an activity surface for supporting objects, for example, food, drinks, books, etc. The apparatus 101 may also be attached to railings of balconies, decks, patios, fences, boats, walls, etc. The apparatus 101 comprises a mountable backsplash 102, a foldable support platform 103, and multiple connectors 104 of the foldable support platform 103. The connectors 104 may, for example, be multiple support pegs. The connectors 104 may be four support pegs as exemplarily illustrated in FIG. 1. An isometric view of the apparatus 101 with the foldable support platform 103 in a horizontal position is exemplarily illustrated in FIG. 2A. A rear view of the apparatus 101 with the foldable support platform 103 in a downward position is exemplarily illustrated in FIG. 2C.

Figure 6:
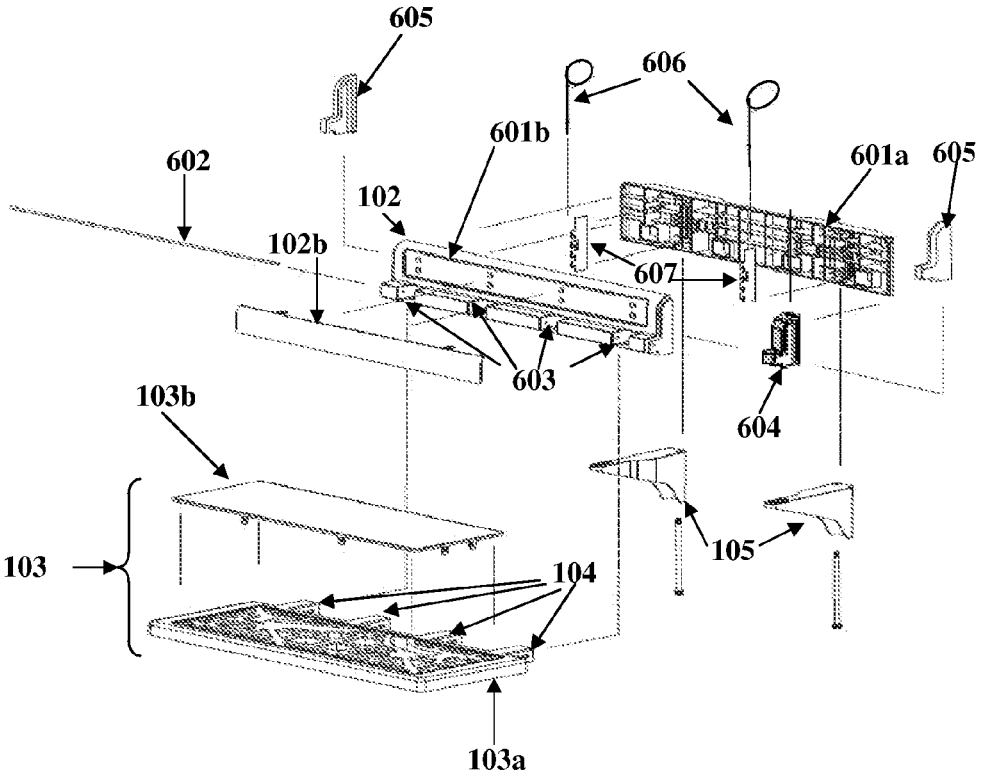
FIG. 6 exemplarily illustrates an exploded view of the apparatus attachable to the barricading structure.

FIG. 6 exemplarily illustrates an exploded view of the apparatus 101. The mountable backsplash 102 may be detachably attached to the barricading structure 1401. The mountable backsplash 102 comprises multiple slots 603. The mountable backsplash 102 prevents objects from falling off the foldable support platform 103. For example, if a user places a book or a drink on the activity surface provided by the foldable support platform 103, the mountable backsplash 102 prevents the book or drink from falling off the balcony. The mountable backsplash 102 is of a clamshell design thereby allowing barricading structure 1401 connections to be hidden from view. The mountable backsplash 102 may be designed to accommodate ground posts of varying size present between adjacent barricading structures 1401 such that two or more apparatus 101 may be connected to each other to run adjacent to one another to provide a continuous activity surface along the barricading structure 1401. The rear surface of the mountable backsplash 102 has designated spots 204 to accommodate the ground posts thereby allowing the apparatus 101 to be installed at the same level on the barricading structure 1401, as exemplarily illustrated in FIGS. 17 and 18.

The mountable backsplash 102 comprises a back support 102*a* and a second inlay 102*b*. The second inlay 102*b* is fitted into the back support 102*a*. The back support 102*a* of the mountable backsplash 102 is exemplarily illustrated in FIG. 8. The back support 102*a* provides a means to attach and support the apparatus 101 to the barricading structure 1401. The back support 102*a* of the mountable backsplash 102 comprises a first section 601*a* and a second section 601*b* as illustrated in FIG. 6. The first section 601*a* is positioned behind the second section 601*b* of the back support 102*a* and against the barricading structure 1401. The apparatus 101 may further comprise end caps 605 for providing a protective covering at both ends of the mountable backsplash 102. The first section 601*a* and the second section 601*b* of the back support 102*a* are fitted together and may be sealed at both ends with the end caps 605. The second inlay 102*b* is a replaceable inlay that fits into the back support 102*a* of the mountable backsplash 102. The second inlay 102*b* of the mountable backsplash 102 is exemplarily illustrated in FIG. 9.

The back support 102*a* may comprise guides to enable the connectors 104 to attach to the slots 603 of the back support 102*a*. The combination of the back support 102*a*, the second inlay 102*b*, the connectors 104, and the end caps 605 provide the support and strength for connecting the foldable support platform 103 to the mountable backsplash 102. The mountable backsplash 102 has maximum support strength when each of the back support 102*a*, the second inlay 102*b*, the connectors 104, and the end caps 605 are used.

Figure 10A:
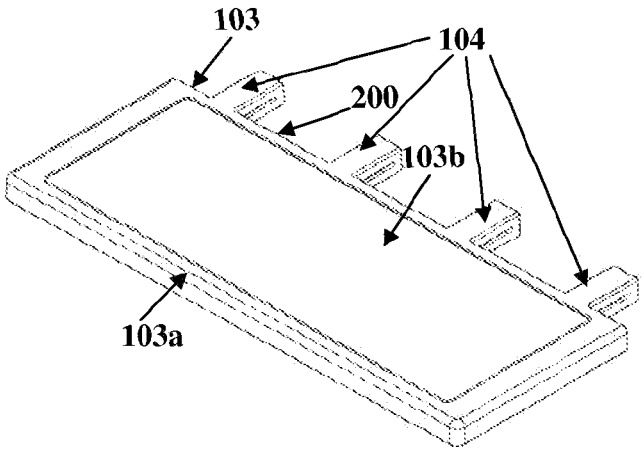
FIG. 10A exemplarily illustrates an isometric view of the foldable support platform.
Figure 10B:
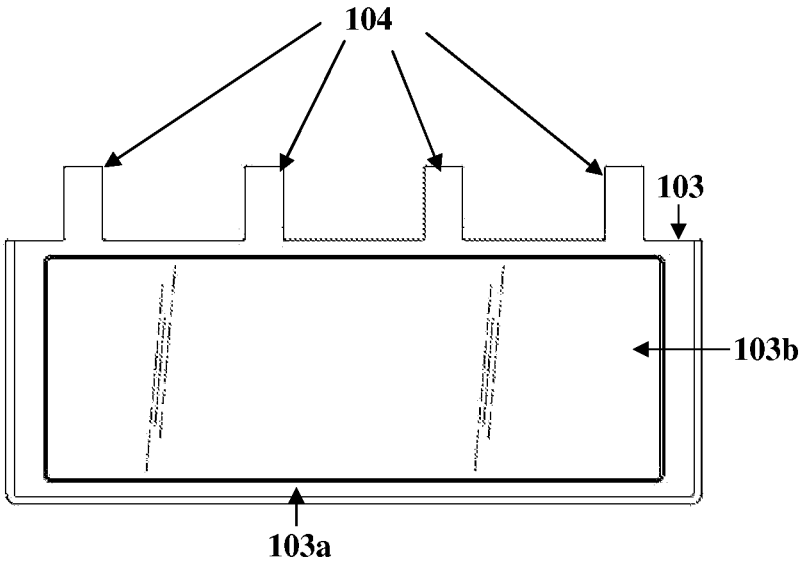
FIG. 10B exemplarily illustrates a top view of the foldable support platform.
Figure 12:
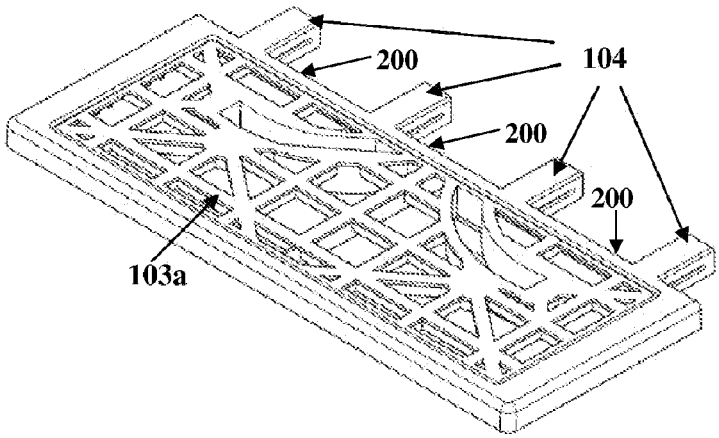
FIG. 12 exemplarily illustrates a support structure of the foldable support platform.
Figure 13:
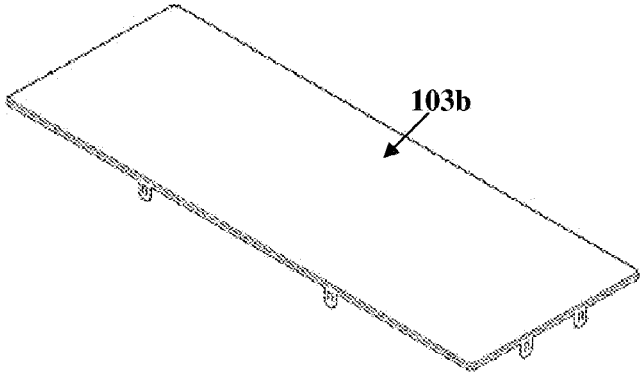
FIG. 13 exemplarily illustrates a first inlay of the foldable support platform.

The foldable support platform 103 is attached to the mountable backsplash 102 via the connectors 104 illustrated in FIG. 10A. The foldable support platform 103 provides a platform on which objects, for example, a book, a drink, food, etc. may be placed. An isometric view of the foldable support platform 103 is illustrated in FIG. 10A. A top view of the foldable support platform 103 is exemplarily illustrated in FIG. 10B. The foldable support platform 103 comprises a support structure 103*a* as illustrated in FIG. 12 and a first inlay 103*b* as illustrated in FIG. 13. The support structure 103*a* supports the first inlay 103*b*. The first inlay 103*b* is a replaceable inlay fitted into the support structure 103*a* and provides an activity surface on which one or more objects may be placed. The activity surface provided by the first inlay 103*b* holds the placed objects.

The second inlay 102*b* and the first inlay 103*b* may be of different colors and different designs. The second inlay 102*b* and the first inlay 103*b* may be replaceable in the event of damage to the apparatus 101, or may be replaced to add aesthetic appeal to the apparatus 101. The replaceability of the second inlay 102*b* and the first inlay 103*b* allow the decor of the apparatus 101 to be altered to match the decor of a home, balcony, deck, etc., based on the location of installation of the apparatus 101. The mountable backsplash 102 and the foldable support platform 103 may be rounded at the edges for appearance and safety. The foldable support platform 103 may be positioned in a horizontal position, or folded to a downward position. The mountable backsplash 102 and the foldable support platform 103 may comprise multiple openings (not shown) for draining accumulated water.

Figure 2A:
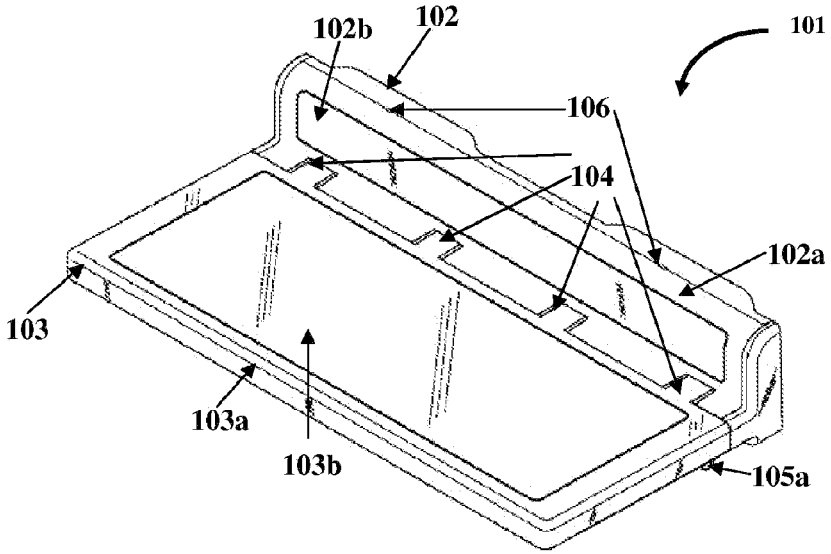
FIG. 2A exemplarily illustrates an isometric view of the apparatus with the foldable support platform in a horizontal position.
Figure 14:
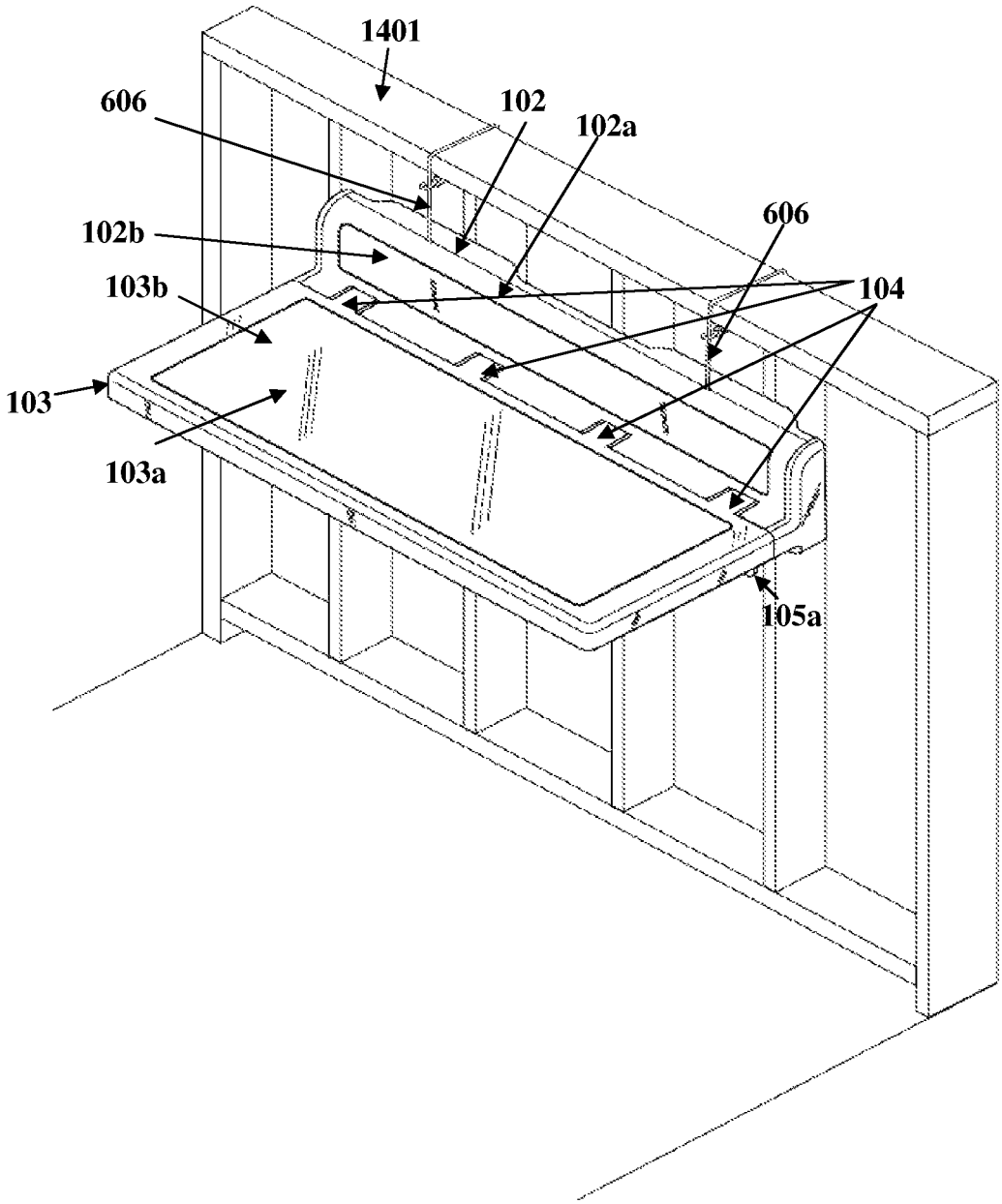
FIG. 14 exemplarily illustrates the apparatus detachably attached to the barricading structure for providing the activity surface.
Figure 15:
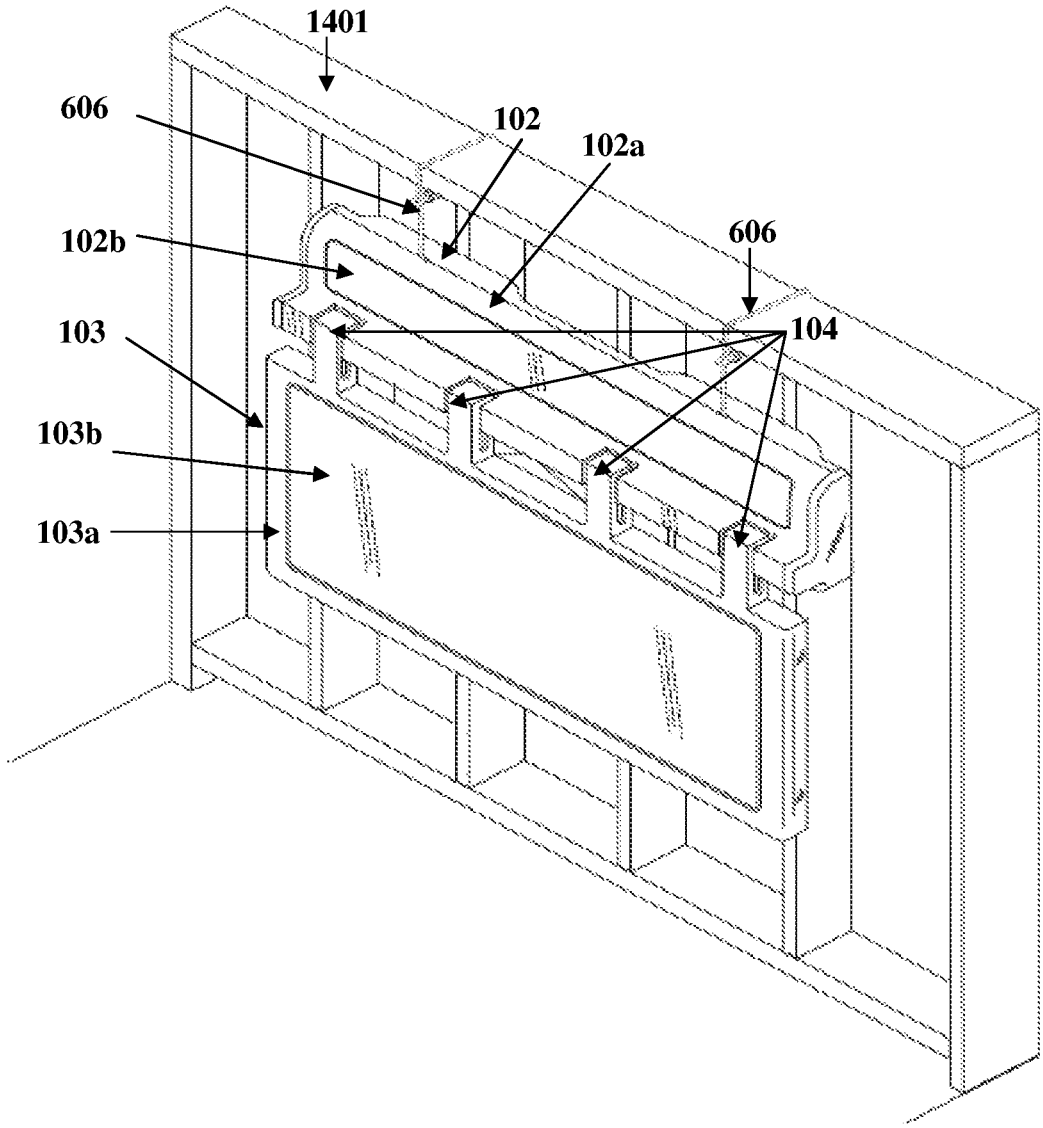
FIG. 15 exemplarily illustrates the apparatus detachably attached in the downward position to the barricading structure.

The connectors 104 of the foldable support platform 103 are accommodated in the slots 603 of the mountable backsplash 102 for connecting the foldable support platform 103 to the mountable backsplash 102. The connectors 104 are hinged to the mountable backsplash 102 using a hinge pin 602 to facilitate pivotal connection of the foldable support platform 103 to the mountable backsplash 102. The hinge pin 602 inserted through the connectors 104 connects the foldable support platform 103 to the mountable backsplash 102. Axial movement of the connectors 104 about the hinge pin 602 facilitates movement of the foldable support platform 103 from the horizontal position to the vertical position as illustrated in FIG. 14 and FIG. 15. The hinge pin 602 and the connectors 104 provide stability and support to the foldable support platform 103 when the foldable support platform 103 is moved to the horizontal position as illustrated in FIG. 2A. A support strap may be provided on the apparatus 101 for fastening the foldable support platform 103 when lowered to the vertical position to prevent unintentional movement.

Figure 2B:
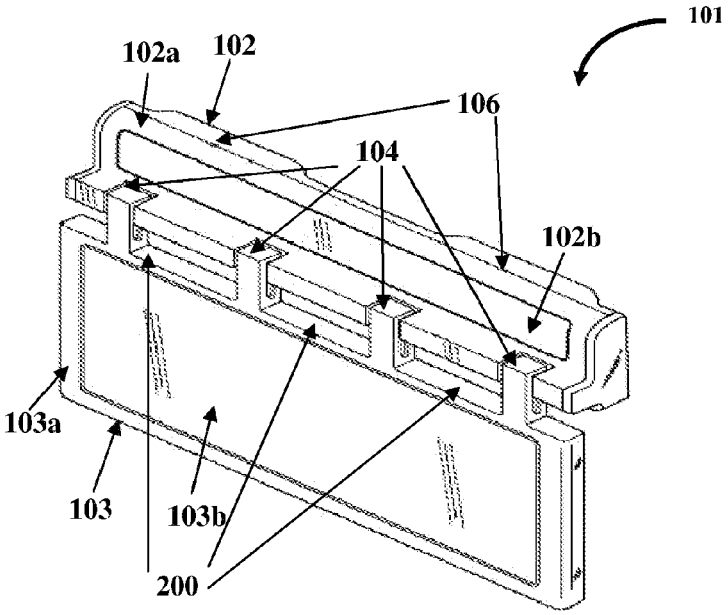
FIG. 2B exemplarily illustrates a side view of the apparatus with the foldable support platform in a downward position.
Figure 8:
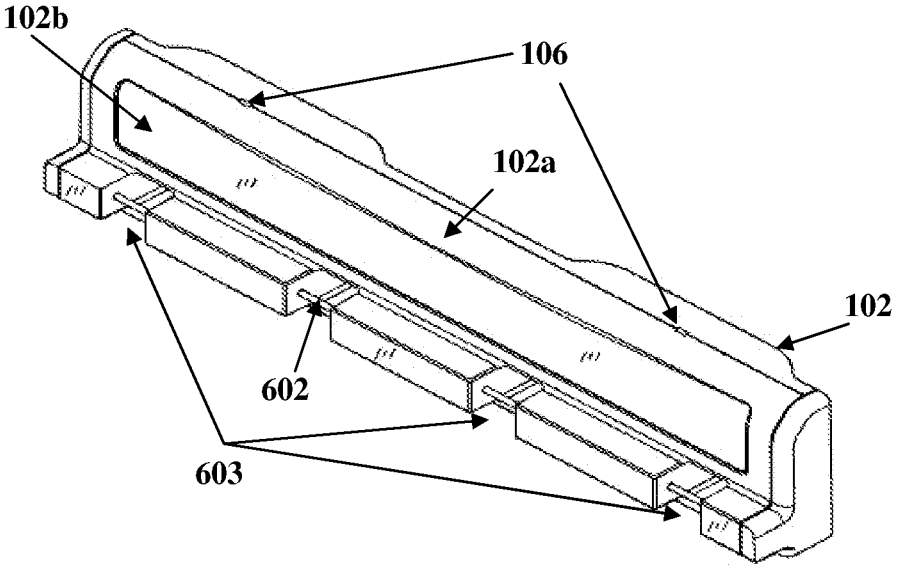
FIG. 8 exemplarily illustrates a back support of the mountable backsplash.
Figure 9:
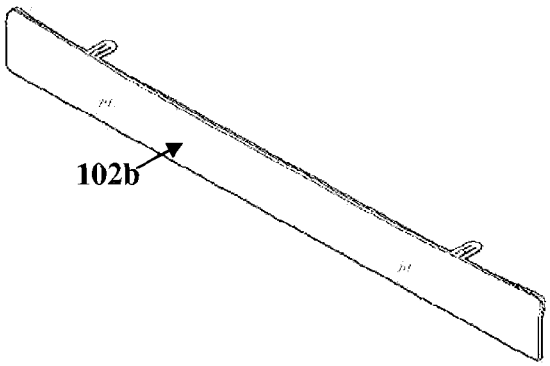
FIG. 9 exemplarily illustrates a second inlay of the mountable backsplash.

The foldable support platform 103 comprises multiple connectors 104 extending from a side of the foldable support platform 103 proximal to the mountable backsplash 102. The connectors 104 are illustrated in FIGS. 1, 2A, 2B, 3B, and 10A-10B. Each of the connectors 104 defines a connector slot 200 penetrating through the connector 104, as illustrated in FIG. 2B. Each of the connectors 104 are disposed within one of the backsplash slots 603. The hinge pin 602 penetrates each of the connector slots. The backsplash slots 603 are illustrated in FIG. 8. Each of the slots 603 of the mountable backsplash 102 communicates through the corresponding connectors 104 generally parallel to side surface of the foldable support platform 103 and parallel to the surface of the barricading structure 1401 to which the apparatus 101 is mounted. The hinge pin 602 illustrated in FIG. 6 passes through openings in each of the slots 603 and the connectors 104, and hence the foldable support platform 103, rotatably and slideably engages the hinge pin 602. The combination of the rotatable and slideable engagement between the connectors 104 and the hinge pin 602 allows the foldable support platform 103 to move between the horizontal position and the downward position and further allows the foldable support platform 103 to be supported in both positions.

In the downward position of the foldable support platform 103, as illustrated in FIG. 2B, the foldable support platform 103 is supported by the hinge pin 602. In the horizontal position, illustrated in FIGS. 1 and 2A, each of the connectors 104 slideably engages a mating connector slot defined by the mountable backsplash 102. The mating connector slots 603 are illustrated in FIG. 6. FIGS. 1, 2A, 4A and 4B illustrate the connectors 104 and the mating connector slots 603 in slideable engagement. The slideable engagement between each of the mating connector slots 603 and each of the connectors 104 constrains the rotation of the connectors 104 about the hinge pin 602 and hence supports the foldable support platform 103 when the foldable support platform 103 is in the horizontal position.

To move from the downward position to the horizontal position, a user using the apparatus 101 disclose herein will rotate the foldable support platform 103 approximately 90 degrees about the hinge pin 602. The user then will slide the foldable support platform 103 toward the mountable backsplash 102. The connectors 104 will slideably engage the mating connector slots 603, thereby supporting the foldable support platform 103 in the horizontal position. A load placed on the foldable support platform 103 when the foldable support platform 103 is in the horizontal position is transferred to the connectors 104, to the mating connector slots 603 and hence to the mountable backsplash 102. To move the foldable support platform 103 from the horizontal position to the downward position, the user reverses the above sequence.

Figure 3A:
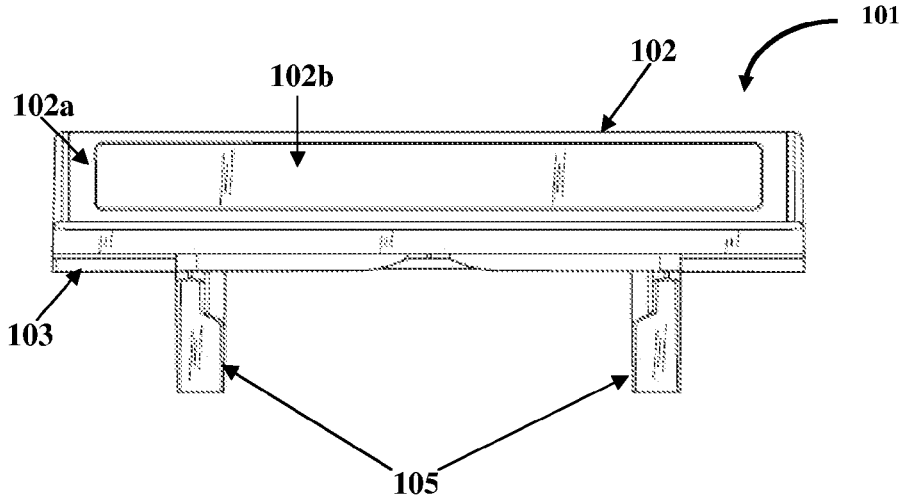
FIG. 3A exemplarily illustrates a front view of the apparatus with the foldable support platform in a horizontal position.
Figure 3B:
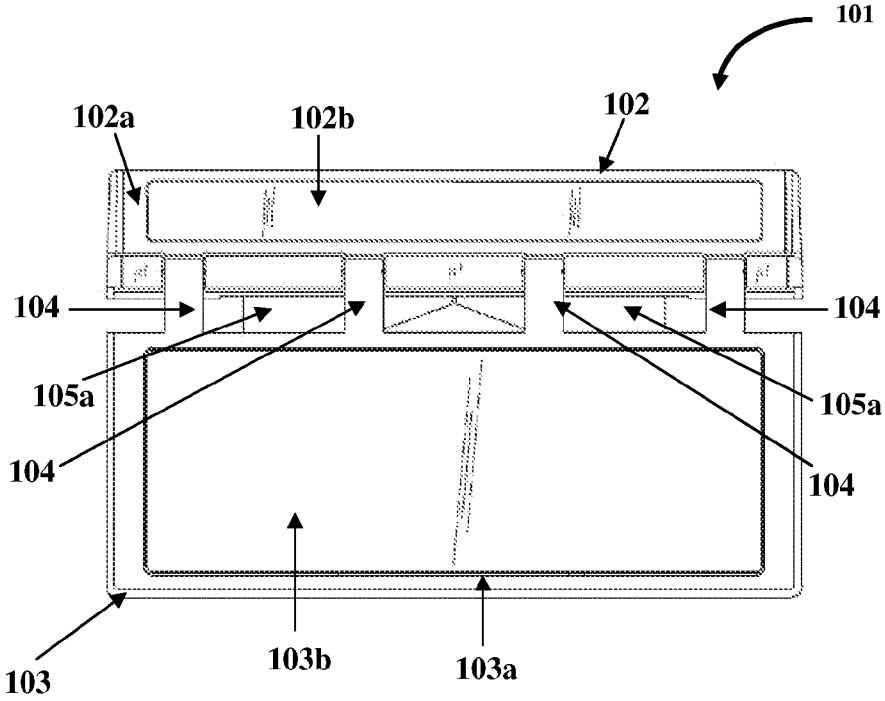
FIG. 3B exemplarily illustrates a front view of the apparatus with the foldable support platform in the downward position.
Figure 4A:
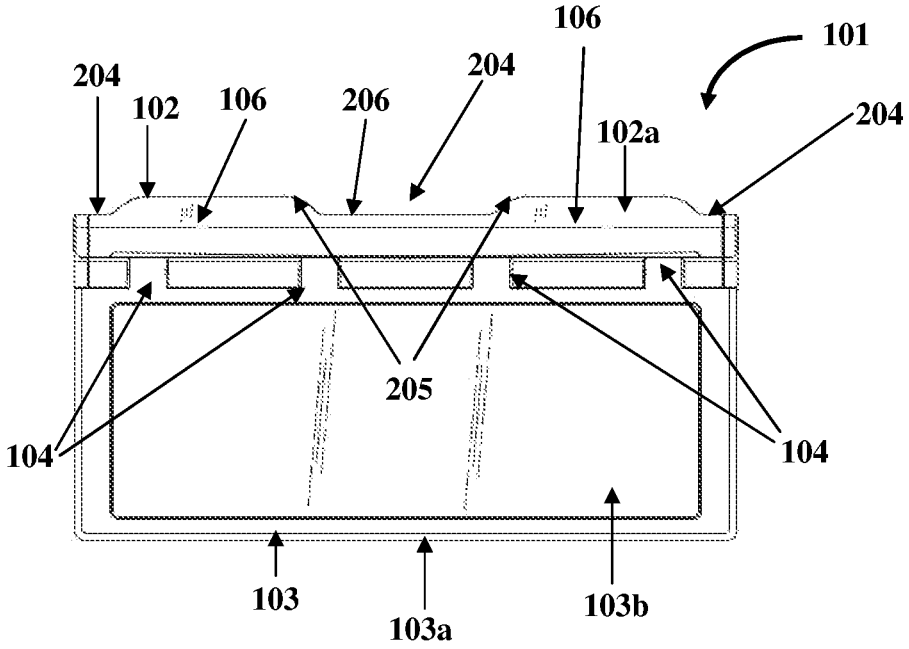
FIG. 4A exemplarily illustrates a top view of the apparatus with the foldable support platform in the horizontal position.
Figure 4B:
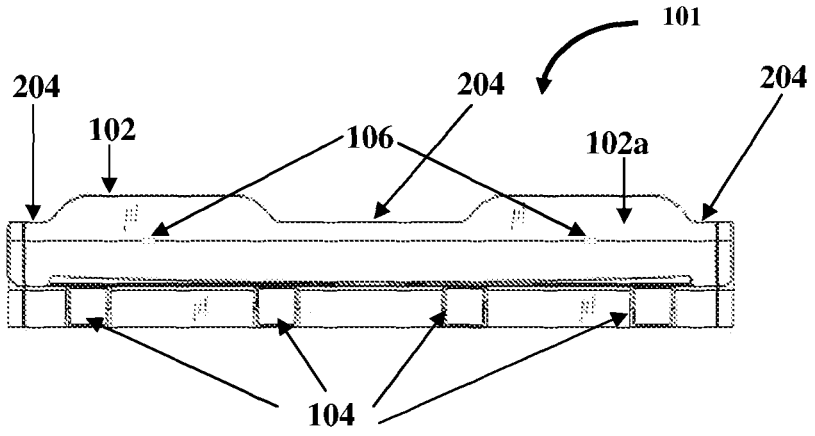
FIG. 4B exemplarily illustrates a top view of the apparatus with the foldable support platform in the downward position.
Figure 5A:
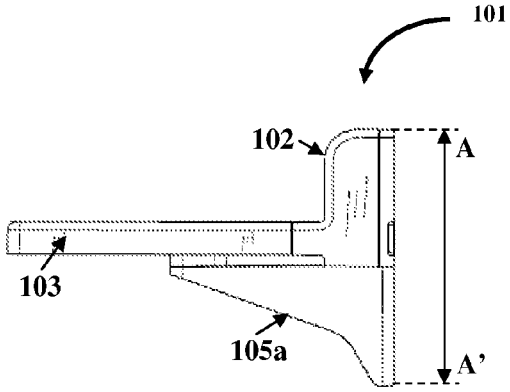
FIG. 5A exemplarily illustrate a side view of the apparatus with the foldable support platform in the horizontal position.
Figure 5B:
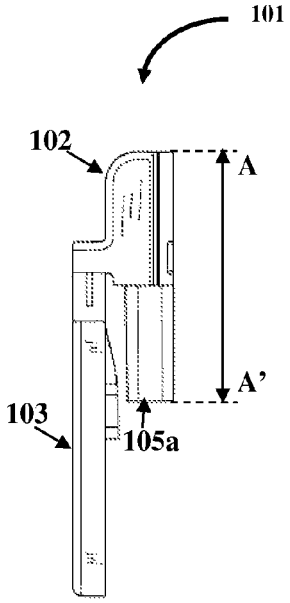
FIG. 5B exemplarily illustrate a side view of the apparatus with the foldable support platform in the downward position.
Figure 7A:
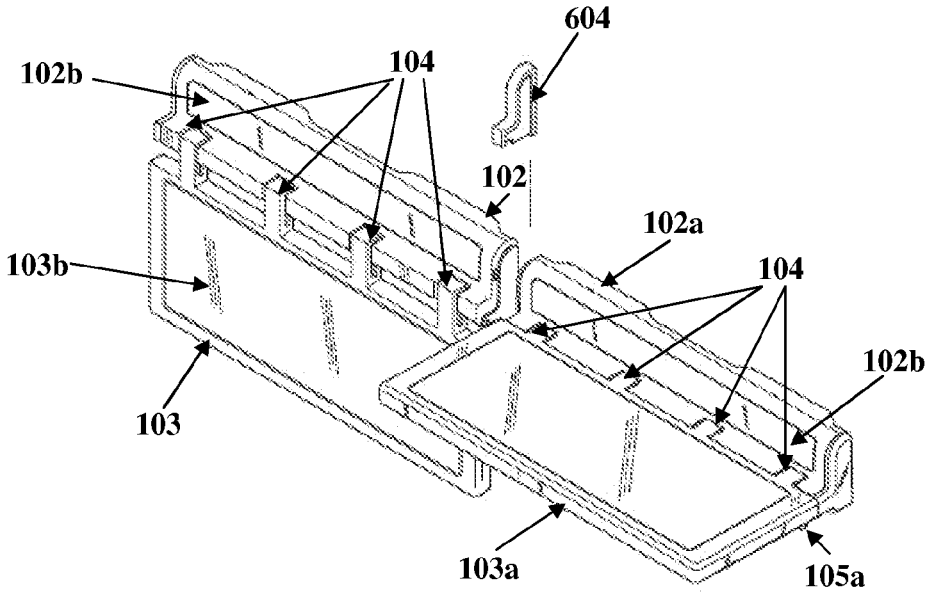
FIG. 7A exemplarily illustrates an isometric view of two apparatuses prior to connection.
Figure 7B:
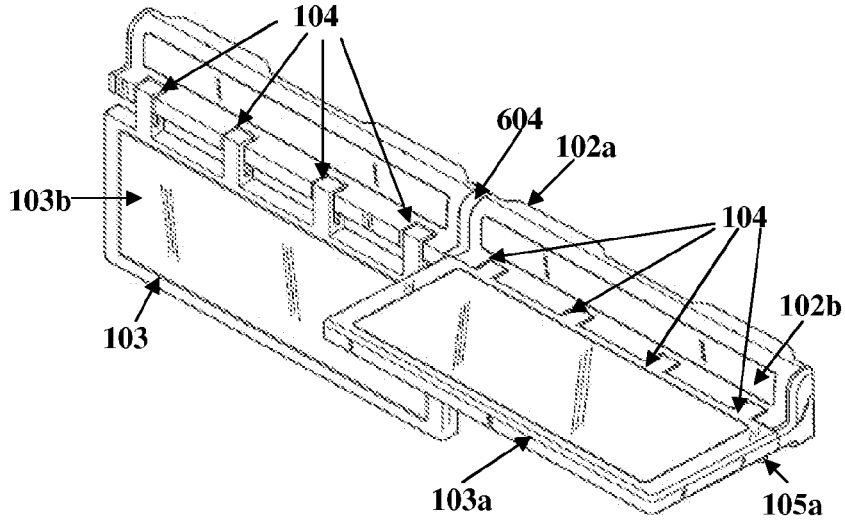
FIG. 7B exemplarily illustrates an isometric view of two apparatuses connected together, wherein one apparatus is in a folded position and the other apparatus is in an unfolded position.
Figure 7C:
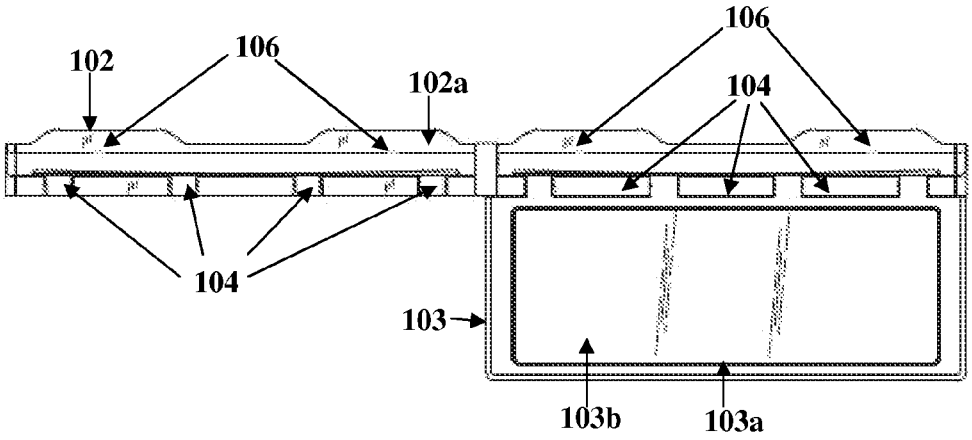
FIG. 7C exemplarily illustrates a top view of two apparatuses connected together.
Figure 7D:
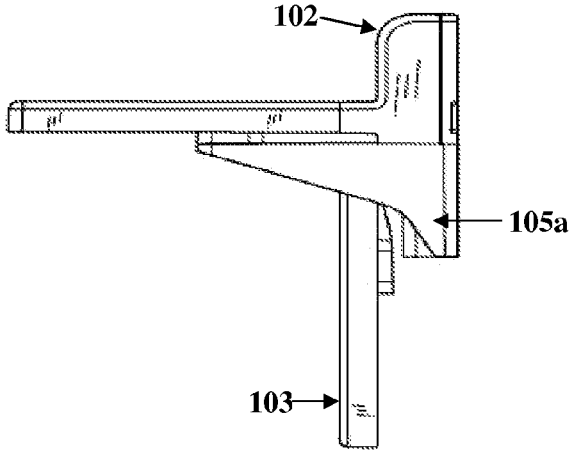
FIG. 7D exemplarily illustrates a side view of two apparatuses connected together.
Figure 11A:
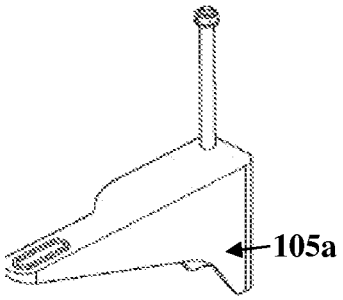
FIG. 11A exemplarily illustrates one of the leg supports of the apparatus.
Figure 11B:
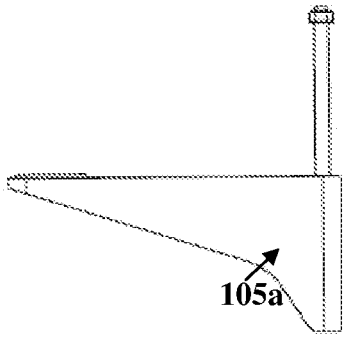
FIG. 11B exemplarily illustrates a side view of one of the leg supports of the apparatus.

As illustrated in FIGS. 3A, 5A and 7D, the foldable support platform 103 is also selectably supported by multiple leg supports 105 when the foldable support platform 102 is in the horizontal position. Construction of the leg supports 105 is illustrated in FIGS. 6, 11A and 11B. Each leg support 105*a* is hinged to rotate about a vertical axis of rotation. The vertical axis of rotation is defined by an axle, which may be a bolt. The axle and vertical axis of rotation are illustrated in FIGS. 6, 11A and 11B. The axle is attached to and supported by the mountable backsplash 102. FIGS. 5A and 5B illustrate a line AA'. Line AA' represents the distance between top of the backsplash 102 and the bottom of the leg support 105*a*. The rear of the backsplash 102 and rear of the leg supports 105 are on the same plane, thereby creating a flush surface area and allowing the apparatus 101 to be securely attached to the barricading structure 1401. The flush surface area allows attachment of the apparatus 101 to different barricading structures 1401 for example, a railing on a balcony, deck, patio, etc.

The leg support 105*a* has a deployed position as illustrated in FIGS. 3A, 5A and 7D. In the deployed position, the leg support 105*a* is rotated about the vertical axis of rotation so that the leg support 105*a* is generally perpendicular to the surface of the foldable support platform 103 when the foldable support platform 103 is in the horizontal position. The foldable support platform 103 comprises a ramp in the shape of a quadrant. The ramp defines a leg support engagement location in a spaced-apart relation to the hinge pin 602 when the foldable support platform 103 is in the horizontal position. When the foldable support platform 103 is in the horizontal position, the leg support 105*a* engages the leg support engagement location of the foldable support platform 103. A load placed on the foldable support platform 103 when the foldable support platform 103 is in the horizontal position is transferred to the leg support engagement location, to the leg support 105*a*, to the axle defining the vertical axis of rotation of the leg support 105*a*, and hence to the backsplash 102.

Figure 2C:
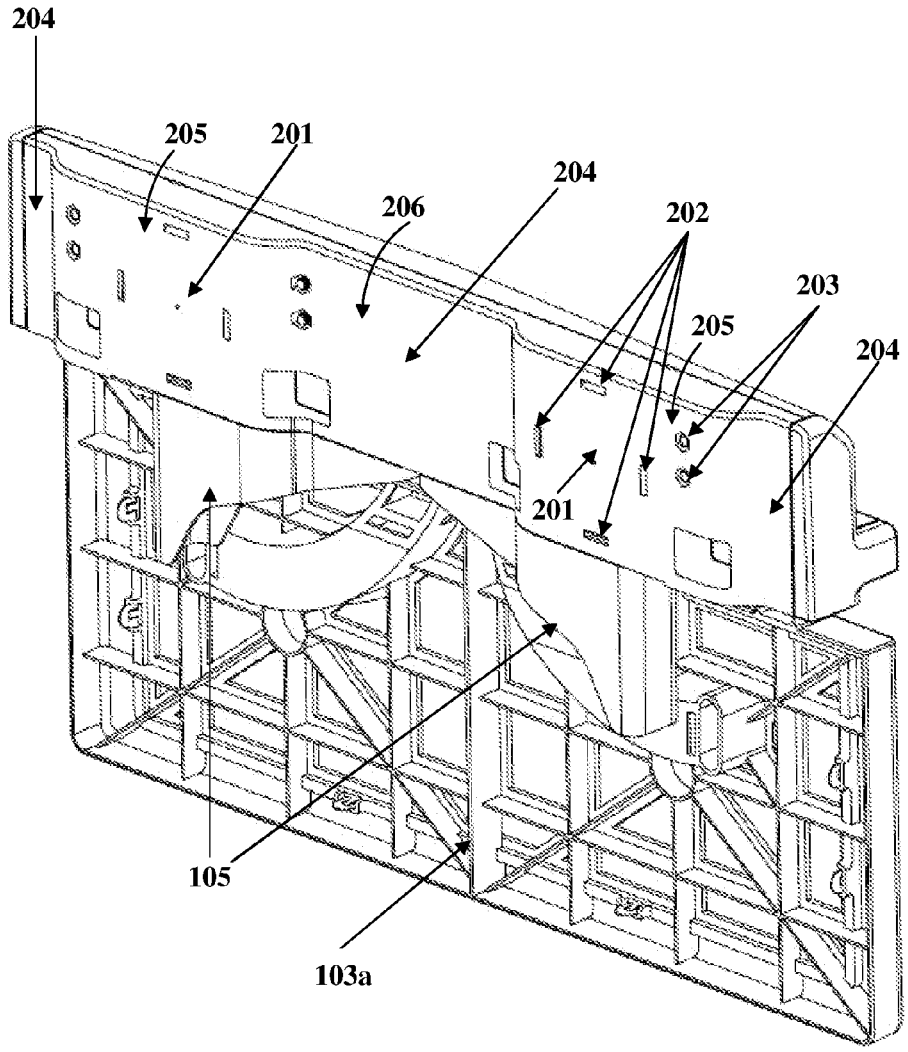
FIG. 2C exemplarily illustrates a rear view of the apparatus with the foldable support platform in a downward position.

The leg support 105*a* also has a stored position illustrated by FIGS. 2C and 5B. In the stored position, the leg support 105*a* is rotated about the vertical axis approximately 90 degrees from the deployed position so that the leg support 105*a* is oriented generally parallel to the surface of the foldable support platform 103 when the foldable support platform 103 is in the downward position. The downward position of the foldable support platform 103 is illustrated in FIGS. 2B, 2C, 3B, 4B, 5B and 15. In the stored position, the leg support 105*a* does not engage the ramp or the leg support engagement location and does not provide support to the foldable support platform 103. The leg support 105*a* also may be located within 90 degrees range of motion intermediate between the fully deployed position illustrated by FIG. 3A and the stored position illustrated by FIGS. 2C and 5B. When the leg support 105*a* is in an intermediate position and the foldable support platform 103 is in the horizontal position, the leg support 105*a* engages the quadrant-shaped ramp at an intermediate location along the quadrant. Intermediate locations along the ramp provide less rise than does the leg support engaging location, allowing a user to level the foldable support platform 103 by selecting an intermediate position for the leg support 105*a* that corresponds to a level position for the foldable support platform 103.

A front view of the apparatus 101 with the foldable support platform 103 in a horizontal position is exemplarily illustrated in FIG. 3A. The foldable support platform 103 may be folded to a downward position when not in use as illustrated in FIG. 2B. A side view of the apparatus 101 with the foldable support platform 103 in a downward position is exemplarily illustrated in FIG. 2B. A front view of the apparatus 101 with the foldable support platform 103 in the downward position is exemplarily illustrated in FIG. 3B. A top view of the apparatus 101 with the foldable support platform 103 in the horizontal position is exemplarily illustrated in FIG. 4A. A top view of the apparatus 101 with the foldable support platform 103 in the downward position is exemplarily illustrated in FIG. 4B.

The apparatus 101 further comprises a locking system for locking the mountable backsplash 102 to the barricading structure 1401. The locking system may comprise, for example, one or more of a hook panel 607, multiple height adjustment cables 606, suction cups, an adjustable hooking unit, and multiple hook and loop fasteners. The first section 601*a* of the back support 102*a* may, for example, comprise multiple openings 201, 202, and 203 herein referred to as "holes" for inserting the suction cups, the hook and loop fasteners, and the bolts respectively. The suction cup holes 201, the hook and loop fastener holes 202, and the bolt holes 203 are exemplarily illustrated in FIG. 2C. Bolts may be inserted in the bolt holes 203 for connecting the first section 601*a* and the second section 601*b* of the back support 102*a*. The bolts that pass through the bolt holes 203 may be drilled to a wall to position the mountable backsplash 102 on the barricading structure 1401. The hook panel 607 may be attached inside a back support 102*a* of the mountable backsplash 102. The hook panel 607 may be attached in between the second section 601*b* and the first section 601*a* of the back support 102*a* into an opening provided between the second section 601*b* and the first section 601*a*. Multiple hooks may be provided on the hook panel 607 to suspend the apparatus 101. In addition to the hooks, height adjustment cables 606 may also attach to the hook panel 607.

The hook panel 607 secures the height adjustment cables 606 to suspend the apparatus 101 using the height adjustment cables 606. The height adjustment cables 606 pass through cable slots 106 provided in the back support 102*a* of the backsplash 102. The cable slots 106 may accommodate cables or hooks, for example, "J" shaped hooks, for suspension. Corresponding slots are provided in both the first section 601*a* and the second section 601*b* such that the corresponding slots come together to form the cable slots 106 when the first section 601*a* and the second section 601*b* are assembled together. The hook panel 607 provides multiple height adjustment levels for adjusting height of the apparatus 101 on the barricading structure 1401 using the height adjustment cables 606. The hook panel 607 controls adjustment of height of the apparatus 101 on the barricading structure 1401 to the height adjustment levels using the height adjustment cables 606.

The hook panel 607 may comprise multiple linear hooks to provide the multiple height adjustment levels. The height of the apparatus 101 may be adjusted to the multiple height adjustment levels by using one of the multiple linear hooks on the hook panel 607. The hook panel 607 may be hidden from view. The height adjustment cables 606 may be looped cables secured to the hook panel 607 in order to adjust the height of the apparatus 101 on the barricading structure 1401. The height adjustment cables 606 may go over the barricading structure 1401 and be secured to the hook panel 607. The height adjustment cables 606 also work with different size barricading structures.

The hook and loop fasteners (not shown), for example, Velcro®, may be used to fasten the apparatus 101 to vertical or horizontal pickets of the barricading structure 1401. The hook and loop fasteners are inserted into the hook and loop fastener holes 202 of the first section 601*a* of the back support 102*a*. Multiple leg supports 105 support weight of the foldable support platform 103 when the foldable support platform 103 is in a downward position. The hook and loop fasteners therefore allow that the foldable support platform 103 not to flap during windy weather conditions.

The apparatus 101 connects to the barricading structure 1401 at four connection points. Two height adjustment cables 606 go over the barricading structure 1401 and are secured to the hook panel 607 through loops on the height adjustment cables 606. Two hook and loop fasteners may also be fastened around the vertical or horizontal pickets on the barricading structure 1401 for securing the apparatus 101 and providing stability. Alternatively, the apparatus 101 may also exemplarily be secured to a wall by drilling holes in the wall and using screws to secure the apparatus 101.

The rear surface of the mountable backsplash 102 comprises one or more openings, for example, the suction cup holes 201 for inserting the suction cups. When there is no clearance between the barricading structure 1401 and a rear smooth or rough surface behind the barricading structure 1401, the suction cups may be used to fasten the apparatus 101 to the smooth surface, for example, a glass surface or a coarse surface. The suction cups may be used to replace the hook and loop fasteners. The height adjustment cables 606 may be used if a clearance between the barricading structure 1401 and the rear smooth or coarse surface is provided. The adjustable hooking unit (not shown) may be attached to the hook panel 607 when the clearance between the barricading structure 1401 and rear smooth or coarse surface is provided. The adjustable hooking unit resembles a chain comprising multiple loops that attach to the hook panel 607.

The mountable backsplash 102 is mounted onto the barricading structure 1401 using the adjustable hooking unit attached to the hook panel 607. The adjustable hooking unit may be used if the apparatus 101 cannot be attached to a top rail of the barricading structure 1401, for example, a railing structure topped with a glass enclosure such that no space for attaching the apparatus 101 is available. The adjustable hooking unit may be used with an adjustable screw for clamping to railings of different dimensions. Height adjustment cables 606 may also be used with railings of different dimensions. The height adjustment cables 606 may be fastened to an opening in the barricading structure 1401.

The height of the apparatus 101 is adjustable to one of the height adjustment levels by securing the loops in the adjustable hooking unit to one of the linear hooks on the hook panel 607. The adjustable hooking unit may, for example, be shaped like the letter "J" and may be attached using the adjustable vise screws when clearance between the barricading structure 1401 and the rear smooth or coarse surface is not provided. The adjustable vise screws may be clamped onto barricading structures of different widths. The adjustable hooking unit may be used in conjunction with the suction cups to provide the locking system in cases where the hook panel 607, height adjustment cables 606, and the hook and loop fasteners are not be employed. The adjustable hooking unit may, for example, be made of a weatherproofed metal or stainless steel.

FIG. 11A and FIG. 11B exemplarily illustrate the leg supports 105 of the apparatus 101. The leg supports 105 are hinged to the mountable backsplash 102 for supporting weight of the foldable support platform 103 when the foldable support platform 103 is in the horizontal position. A clearance is provided between the leg supports 105 and an underlying surface. The leg supports 105 may be aligned to a folded position or an unfolded position. The leg supports 105 are foldable and may be aligned to a folded position under the mountable backsplash 102 to place the foldable support platform 103 in the downward position. The leg supports 105 have a starting position and a stopping position built below the foldable support platform 103 to help alignment of the leg supports 105 to the unfolded position and the folded position. The leg supports 105 beneath the mountable backsplash 102 are aligned to the unfolded position from the folded position to support the foldable support platform 103. The leg supports 105 may be slid along the hinge pin 602. The connectors 104 comprise an opening for allowing the leg supports 105 to slide along the hinge pin 602.

The leg supports 105 follow a ramp to be impressed into underside of the support structure 103*a* of the foldable support platform 103. The ramp is followed until the leg supports 105 lock in place during the folding and unfolding operations. The leg supports 105 allow chairs to be placed under the foldable support platform 103. Enough leg space is provided since no adjustment around the leg supports 105 of the apparatus 101 is required. The apparatus 101 may be made of a weather resistant material and a heat resistant material, for example, plastic, stainless steel, etc. The apparatus 101 is designed such that adaptability to most of the barricading structures is achieved.

FIG. 14 exemplarily illustrates the apparatus 101 attached to the barricading structure 1401 for providing the activity surface. The apparatus 101 does not use screws or require holes to be drilled into the barricading structure 1401. The apparatus 101 provides options to be mounted anywhere on the barricading structure 1401. The apparatus 101 may also be directly attachable to a wall, for example, a wall of a small kitchen or study, by drilling methods. Movement of the leg supports 105 may be restricted to a predefined range of angles. The leg supports 105 may comprise stoppers built in at the extremities of the predefined range of angles to prevent movement beyond the predefined range. The apparatus 101 detachably attached in the downward position to the barricading structure 1401 is exemplarily illustrated in FIG. 15.

The leg supports 105 may be aligned to a folded position or an unfolded position. The leg supports 105 are foldable and may be aligned to a folded position under the mountable backsplash 102 to place the foldable support platform 103 in the downward position. The leg supports 105 beneath the mountable backsplash 102 are aligned to an unfolded position from the folded position to support the foldable support platform 103. The leg supports 105 follow a ramp to be impressed into the underside of the support structure 103*a* of the foldable support platform 103. The ramp is followed until the leg supports 105 lock in place during the folding and unfolding operations. The leg supports 105 do not make contact with the floor.

The leg supports 105 allow chairs to be placed under the foldable support platform 103. Enough leg space is provided since no adjustment around the leg supports 105 of the apparatus 101 is required. The apparatus 101 may be made of a weather resistant material and a heat resistant material, for example, plastic, stainless steel, etc. The apparatus 101 is designed such that adaptability to most of the barricading structures is achieved. FIG. 14 exemplarily illustrates the apparatus 101 attached to the barricading structure 1401 for providing the activity surface. The apparatus 101 does not use screws or require holes to be drilled into the barricading structure 1401. The apparatus 101 provides options to be mounted anywhere on the barricading structure 1401.

Figure 7E:
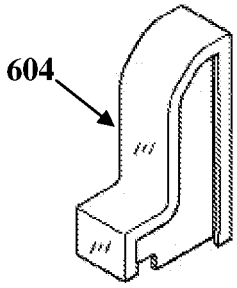
FIG. 7E exemplarily illustrates one of the coupling members for connecting two apparatuses together.

The apparatus 101 may further comprise one or more of coupling members 604 for connecting one or more apparatuses in tandem as a single unit. The coupling members 604 align the apparatuses at an equal relative height with respect to each other. One of the coupling members 604 for connecting two apparatuses together is exemplarily illustrated in FIG. 7E. Each of the connected apparatuses may be used independently. If only one apparatus 101 is used, then the end caps 605 are used at either ends of the mountable backsplash 102. If two apparatuses are connected together in tandem, then two end caps 605 are employed at open ends of the apparatuses and one of the coupling members 604 is used for connecting both the apparatuses. Multiple apparatuses may be connected to form an extensive activity surface using the coupling members 604. Each of the connected apparatuses may facilitate the foldable support platform 103 of each of the apparatuses to be in horizontal position or in a downward position independently based on requirements. FIG. 7A exemplarily illustrates an isometric view of two apparatuses prior to connection. FIG. 7B exemplarily illustrates an isometric view of two apparatuses connected together In FIG. 7B, one apparatus 101 is in the downward position and the other apparatus 101 is in the horizontal position. FIG. 7C exemplarily illustrates a top view of two apparatuses connected together. FIG. 7D exemplarily illustrates a side view of two apparatuses connected together.

Figure 16:
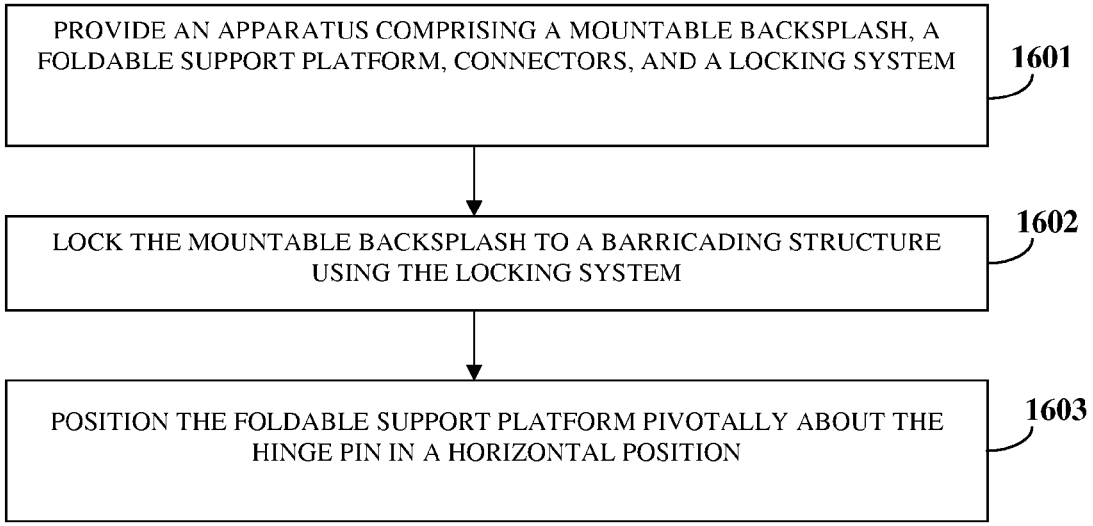
FIG. 16 illustrates a method of providing an activity surface on a barricading structure.

FIG. 16 illustrates a method of providing an activity surface on a barricading structure. The method disclosed herein provides 1601 an apparatus attachable to the barricading structure comprising a mountable backsplash, a foldable support platform, multiple connectors, and a locking system. The mountable backsplash comprising a second inlay fitted into the back support is attached to the barricading structure and prevents objects placed on the foldable support platform from falling off the foldable support platform. The mountable backsplash comprises multiple slots for accommodating the connectors of the foldable support platform. The accommodated connectors are hinged to the mountable backsplash using a hinge pin to facilitate pivotal connection of the foldable support platform to the mountable backsplash. Axial movement of the connectors about the hinge pin enables folding and unfolding of the foldable support platform. The foldable support platform comprises a first inlay fitted into a support structure for providing an activity surface to hold one or more of objects. The foldable support platform is attached to the mountable backsplash via the connectors.

The locking system locks 1602 the apparatus on the barricading structure. The locking system may comprise one ore more of hook and loop fasteners, a hook panel, suction cups, an adjustable hooking unit, and height adjustment cables. The height of the apparatus on the barricading structure may be adjusted using height adjustment cables. A hook panel attached inside a back support of the mountable backsplash provides a multiple height adjustment levels for adjusting of the height of the apparatus on the barricading structure using the height adjustment cables. The apparatus may be suspended using the height adjustment cables. The suction cups and the adjustable hooking unit may be used to attach the apparatus when clearance between the barricading structure and a rear smooth or coarse surface is not provided.

The foldable support platform is positioned 1603 pivotally about the hinge pin in a horizontal position. The foldable support platform attached to the mountable backsplash via the connectors may be positioned in a horizontal position or a downward position. The hinge pin inserted into the connectors enables a pivotal connection of the foldable support platform. The axial movement of the connectors about the hinge pin aids the foldable support platform to be lifted from the downward position to the horizontal position when the activity surface is needed. FIG. 5A exemplarily illustrates a side view of the apparatus with the foldable support platform in the horizontal position. FIG. 5B exemplarily illustrates a side view of the apparatus with the foldable support platform in the downward position. The foldable support platform in the horizontal position may, for example, be used as a shelf or a storage space.

The leg supports are hinged to the mountable backsplash for supporting weight of the foldable support platform when the foldable support platform is in the horizontal position. A clearance is provided between the leg supports and an underlying surface. The leg supports may be aligned to a folded position or an unfolded position. If the activity surface is not in use, the leg supports may be aligned to a folded position under the mountable backsplash and the foldable support platform may be forced down to the downward position.

As an example, the apparatus 101 may be locked on a balcony railing, as exemplarily illustrated in FIG. 14. The foldable support platform 103 may be disposed horizontally for providing an activity surface. The foldable support platform 103 may be connected to the mountable backsplash 102 via the hinge pin 602. The foldable support platform 103 may be pivotally positioned about the hinge pin 602. The apparatus 101 serving as a desk provides the activity surface. The apparatus 101 may also be used as a dining table, a bar, any storage space, etc.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. An apparatus for connection to a barricading structure, the apparatus comprising:

a mountable backsplash, said backsplash being configured for attachment to the barricading structure, said backsplash defining a plurality of backsplash slots;

a hinge pin, said hinge pin penetrating each of said plurality of backsplash slots;

a foldable support platform, said foldable support platform defining a plurality of connectors, each of said plurality of connectors defining a connector slot penetrating through said connector, each of said plurality of connectors being disposed within a one of said plurality of backsplash slots, said hinge pin penetrating each said connector slot;

said plurality of connectors being configured for a slideable engagement with said plurality of backsplash slots, said foldable support platform being supported by said backsplash in a horizontal position when said plurality of connectors is in said slideable engagement with said plurality of backsplash slots and said backsplash is attached to the barricading structure;

said foldable support platform being rotatable about said hinge pin between said horizontal position and a downward position when said plurality of connectors are not in said slideable engagement with said plurality of backsplash slots, a leg support axle, said leg support axle being attached to said backsplash and oriented in a vertical direction when said backsplash is attached to the barricading structure;

a leg support, supported by said leg support axle, said leg support being configured for rotation about said leg support axle between a stored position and a deployed position, said leg support defining an arc when said leg support moves between said stored position and said deployed position, said leg support having an intermediate position between said stored position and said deployed position along said arc, said leg support being configured to support said foldable support platform when said leg support is in said deployed position, said leg support being configured to support said foldable support platform when said leg support is in said intermediate position, said leg support being configured not to support said foldable support platform when said leg support is in said stored position;

a ramp, said ramp being defined by a bottom side of said foldable support platform, said ramp being in the shape of a quadrant, said leg support and said ramp being configured for engagement when said leg support is in said intermediate position and when said leg support is in said deployed position, said ramp defining a rise with respect to said foldable support platform, said rise of said ramp corresponding to said intermediate position of said leg support being less than said rise of said ramp corresponding to said deployed position, whereby a user may level said foldable support platform by selecting said intermediate position or said deployed position of said leg support.

2. The apparatus of claim 1, wherein said foldable support platform comprises a first inlay and wherein said first inlay is replaceable.

3. The apparatus of claim 2, wherein the mountable backsplash comprises a second inlay for preventing objects from falling off the foldable support platform, wherein said second inlay is replaceable.

4. The apparatus of claim 1, further comprising a locking system attached to said backsplash for locking the mountable backsplash to the barricading structure.

5. The apparatus of claim 4, wherein said locking system comprises one or more of a hook panel, a plurality of height adjustment cables, suction cups, an adjustable hooking unit, and a plurality of hook and loop fasteners.

6. The apparatus of claim 4, wherein said locking system comprises a hook panel and a plurality of height adjustment cables, wherein said hook panel is attached inside a back support of the mountable backsplash for securing said height adjustment cables in order to suspend the apparatus using the height adjustment cables, wherein the hook panel is configured to adjust the height of the apparatus on the barricading structure to a plurality of height adjustment levels using the height adjustment cables.

7. The apparatus of claim 4, wherein said locking system comprises a plurality of hook and loop fasteners, wherein said hook and loop fasteners fasten the apparatus to the barricading structure.

8. The apparatus of claim 4, wherein said locking system comprises a plurality of suction cups, wherein a rear surface of the mountable backsplash comprises one or more of a plurality of openings for inserting said suction cups, wherein the suction cups fasten the apparatus to one of a smooth surface and a coarse surface.

9. The apparatus of claim 4, wherein said locking system comprises an adjustable hooking unit and a hook panel, wherein the mountable backsplash is configured to be mounted onto the barricading structure using said adjustable hooking unit attached to said hook panel.

10. The apparatus of claim 1, wherein the barricading structure is one or more of a railing, a fence, a vertical picket, a flat horizontal surface, a flat vertical surface, a wall, a floor, an elevated platform, a desk, and a door fabricated in a plurality of design configurations, wherein the barricading structure is made of one of a plurality of materials and is of different sizes.

11. The apparatus of claim 1, wherein the leg supports support weight of the foldable support platform, and wherein a clearance is provided between the leg supports and an underlying surface.

12. The apparatus of claim 1, wherein the apparatus is made of one of a weather resistant material and a heat resistant material.

13. The apparatus of claim 1, wherein the mountable backsplash and the foldable support platform comprise a plurality of openings for draining accumulated water.

14. The apparatus of claim 1, further comprising one or more coupling members for connecting a plurality of apparatuses and aligning said apparatuses at an equal level with respect to each other, wherein each of said connected apparatuses are used independently.

15. The apparatus of claim 1, wherein the mountable backsplash and the foldable support platform is rounded at edges for appearance and safety.

16. The apparatus of claim 1, further comprising a plurality of end caps for providing a protective covering for both ends of the mountable backsplash.

* * * * *